US012173726B2

(12) United States Patent
Engert et al.

(10) Patent No.: US 12,173,726 B2
(45) Date of Patent: Dec. 24, 2024

(54) VENTILATION UNIT

(71) Applicant: ebm-papst Mulfingen GmbH & Co. KG, Mulfingen (DE)

(72) Inventors: Markus Engert, Lauda-Königshofen (DE); Daniel Conrad, Langenbrettach (DE); Dimitri Mehlmeister, Bamberg (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 696 days.

(21) Appl. No.: 17/299,469

(22) PCT Filed: Dec. 10, 2019

(86) PCT No.: PCT/EP2019/084497
§ 371 (c)(1),
(2) Date: Jun. 3, 2021

(87) PCT Pub. No.: WO2020/120506
PCT Pub. Date: Jun. 18, 2020

(65) Prior Publication Data

US 2022/0025902 A1 Jan. 27, 2022

(30) Foreign Application Priority Data

Dec. 12, 2018 (DE) ..... 10 2018 132 002.7

(51) Int. Cl.
*F04D 29/58* (2006.01)
*F04D 29/52* (2006.01)

(52) U.S. Cl.
CPC ..... *F04D 29/5826* (2013.01); *F04D 29/522* (2013.01)

(58) Field of Classification Search
CPC ..... F04D 29/522; F04D 29/5826
(Continued)

(56) References Cited

U.S. PATENT DOCUMENTS 3,937,192 A * 2/1976 Longhouse ..... F01P 5/06 123/41.58
5,342,173 A * 8/1994 Vera ..... F04D 29/326 416/169 A (Continued)

FOREIGN PATENT DOCUMENTS

CN 1603632 A 4/2005
CN 102844575 A 12/2012

(Continued)

OTHER PUBLICATIONS

Search report from copending German Application No. 102018132002.7 mailed Mar. 4, 2020.

(Continued)

*Primary Examiner* — Avinash A Savani
*Assistant Examiner* — Dana K Tighe
(74) *Attorney, Agent, or Firm* — Harness, Dickey & Pierce, P.L.C.

(57) ABSTRACT

A ventilation unit (1) is formed by at least one fan (2), a heat exchanger, axially spaced from the fan (2), and a housing (3). The housing (3) has a first housing section (4), with a constant flow cross-section, where the heat exchanger is arranged. A second housing section (5) adjoins the first section (4) in the axial flow direction. The fan (2) is arranged on the second housing section (5) in the axial flow direction. During operation, the fan conveys air through the heat exchanger, arranged in the first housing section (4), and through the second housing section (5). The flow cross-section of the second housing section (5) is reduced in the flow direction from the first housing section (4) to the fan (2) by an adaptation to the form of housing wall sections (6, 6') of the second housing section (5).

13 Claims, 3 Drawing Sheets

(58) Field of Classification Search
USPC ..... 454/228
See application file for complete search history.

(56) References Cited

U.S. PATENT DOCUMENTS

| | | | | |
|---|---|---|---|---|
| 5,649,587 | A * | 7/1997 | Plant | F04D 29/545 165/41 |
| 5,740,766 | A * | 4/1998 | Moser | F01P 5/06 415/173.6 |
| 6,209,627 | B1 * | 4/2001 | Hasumi | F01P 5/06 165/125 |
| 6,676,371 | B1 * | 1/2004 | Brown | F04D 29/023 248/229.22 |
| 7,114,921 | B2 * | 10/2006 | Iwasaki | F04D 29/326 416/189 |
| 9,334,877 | B2 * | 5/2016 | Nicholls | F04D 29/58 |
| 9,676,422 | B2 * | 6/2017 | Schmidt | B62D 25/085 |
| 2009/0129918 | A1 * | 5/2009 | Takeuchi | F04D 25/166 415/199.4 |
| 2011/0044809 | A1 | 2/2011 | Stagg et al. | |
| 2011/0217164 | A1 * | 9/2011 | Cote | F04D 29/547 415/223 |
| 2018/0335244 | A1 | 11/2018 | Haaf et al. | |

FOREIGN PATENT DOCUMENTS

| | | | |
|---|---|---|---|
| CN | 207080384 | U | 3/2018 |
| DE | 202011004708 | U1 | 7/2011 |
| DE | 202017101353 | U1 | 5/2017 |
| DE | 102016111136 | A1 | 12/2017 |
| DE | 102017111001 | A1 | 11/2018 |
| JP | S59186421 | U | 12/1984 |
| JP | H02242000 | A | 9/1990 |
| JP | 200637733 | A | 2/2006 |
| WO | WO-2015122134 | A1 | 8/2015 |

OTHER PUBLICATIONS

International Search Report and Written Opinion of the International Searching Authority, issued in PCT/EP2019/084497, mailed Mar. 24, 2020; ISA/EP.

European Office Action dated Mar. 6, 2023 in corresponding European Application No. 19828996.9 (5 pages).

Chinese Office Action dated Jul. 26, 2022 in corresponding Chinese Application No. 201980075882.9 (10 pages).

Chinese Office Action dated Dec. 14, 2023 in corresponding Chinese Application No. 201980075882.9.

* cited by examiner

VENTILATION UNIT

CROSS-REFERENCE TO RELATED APPLICATIONS

This application is a 371 U.S. National Phase of International Application No. PCT/EP2019/084497, filed Dec. 10, 2019, which claims priority to German Patent Application No. 10 2018 132 002.7, filed Dec. 12, 2018. The entire disclosures of the above applications are incorporated herein by reference.

FIELD

The disclosure relates to a ventilation unit formed by at least one fan, a heat exchanger, arranged axially spaced from the fan, and a housing.

Generic ventilation units are known from the prior art. In this case, the heat exchanger is arranged in a cuboid housing. A fan with a circular cross-section is placed onto the housing and sucks air through the housing and the heat exchanger. The transition from the housing, which is rectangular in cross-section, to the round fan is problematic with regard to noise generation and pressure build-up, since high turbulences or vortexes are generated.

The object of the disclosure is therefore to provide a ventilation unit that equalizes the flow and thus improves the pressure build-up and reduces noise.

SUMMARY

The object is achieved by the combination of features according to a ventilation unit comprising at least one fan, a heat exchanger, arranged axially spaced from the fan and a housing. The housing has a first housing section and a second housing section. The first housing section has a constant flow cross-section where the heat exchanger is arranged. The second housing section adjoins the first section in the axial flow direction. The fan is arranged at the second housing section and, in operation, the fan conveys air through the heat exchanger, arranged in the first housing section, and through the housing section. The flow cross-section of the second housing section is reduced in the flow direction from the first housing section to the fan by an adaptation of a shape of the housing wall sections of the second housing section.

According to the disclosure, a ventilation unit is formed by at least one fan, a heat exchanger and a housing. The heat exchanger is arranged axially spaced from the fan. The housing has a first housing section with a constant flow cross-section, where the heat exchanger is arranged. In addition, the housing comprises a second housing section adjoining the first section in the axial flow direction. The fan is arranged on the second housing section. During operation, the fan conveys or sucks air through the heat exchanger arranged in the first housing section and through the second housing section. In this case, the flow cross-section of the second housing section is reduced in the direction of flow from the first housing section to the fan by an adaptation of the shape of housing wall sections of the second housing section. The housing wall sections of the second housing section, which are adapted in shape and are adjacent to the at least one fan, form flow guide surfaces aligned with or facing the at least one fan. The flow cross-section is defined by the axial cross-sectional area of the respective housing section perpendicular to the axis of rotation of the fan.

The adaptation of the flow channel through the housing of the ventilation unit by the housing wall shape facing the at least one fan reduces vortex formation and turbulences during the transition from the housing into the at least one fan. The flow is equalized and the pressure build-up and efficiency increased.

In an advantageous embodiment variant, the ventilation unit in the second housing section determines an intake chamber for the at least one fan. A flow can freely pass through the intake chamber. The adaptation of the flow channel in the housing to the at least one fan is thus implemented exclusively via the shape of the housing wall sections.

Preferably, the housing wall sections of the second housing section each extend along a plane. The housing wall sections extend in a straight line as guide surfaces towards the fan. Alternatively, however, the housing wall sections of the second housing section may each have a curved profile shape and extend, for example, in an arcuate manner toward the fan while reducing the flow cross-section.

In an exemplary embodiment of the ventilation unit, the second housing section has an outflow-side axial wall with an axial opening. The at least one fan is arranged, placed, onto the axial wall at the axial opening. The axial wall closes the housing on the side of the at least one fan. The air sucked in by the fan is thus guided exclusively and completely through the axial opening into the fan. In this case, the axial wall forms the closure of the shape-adapted housing wall sections of the second housing section which reduce the flow cross-section towards the fan.

Furthermore, an embodiment of the ventilation unit is advantageous where the first housing section, accommodating the heat exchanger, is formed rectangularly, as viewed in axial section, with two equal or different side lengths. An intake diameter of the at least one fan facing the heat exchanger is smaller than each side length of the rectangular first housing section.

The ventilation unit further includes the housing wall sections of the second housing section formed in sections running obliquely towards an axis of rotation of the at least one fan. In particular, two opposite housing wall sections in each case are identically shaped and run at the same angle towards the fan.

An alternative embodiment of the ventilation unit provides that flow inserts are arranged in the second housing section. They are formed in sections running obliquely towards an axis of rotation of the at least one fan. This reduces the flow cross-section of the second housing section in the direction of the at least one fan. In this case, the flow inserts provide the reduction of the flow cross-section in the second housing section and serve as guide surfaces for the flow aligned with the fan. The lateral housing surface can be formed identically in both the first and the second housing sections since the adaptation of the shape of the flow channel takes place exclusively via the flow inserts.

In a further development of the ventilation unit, the flow inserts are perforated guide plates. A cavity formed between the housing and the guide plates, is filled with sound-absorbing material. This solution takes advantage of the fact that, on the one hand, the flow is directed to the at least one fan via the guide plates and, on the other hand, that while adapting the flow direction, the noise is actively reduced by the sound-absorbing material.

In general, it is fluidically advantageous for the ventilation units to have a ratio of an axial length C of the second housing section extending in the flow direction, to the intake diameter D, of the at least one fan, is specified in a range such that $0.2 \leq C/D \leq 0.5$. In this case, the second housing section begins as measured from the end of the heat exchanger through which the flow passes.

Furthermore, an embodiment of the ventilation unit is fluidically advantageous where the housing, viewed in axial section, is formed rectangularly with two equal or different side lengths X,Y. A ratio of the side lengths X,Y to the intake diameter D of the at least one fan is defined in a range such that $1.1 \leq (X,Y)/D \leq 2.0$, preferably $1.2 \leq (X,Y)/D \leq 1.8$.

The ventilation unit is not limited to embodiments with only one fan. Also comprised are solutions where two or more fans are arranged mounted axially parallel to each other on the axial wall of the second housing section. The cuboid housing sections are to be dimensioned correspondingly longer on one side so that both fans fit next to each other. Apart from that, however, the features presented for the disclosure apply accordingly.

The fan is formed by a fan wheel surrounded by a fan housing through which the flow can pass and which determines the intake diameter.

Preferred is a solution where the intake diameter of the fan housing has a size identical to the axial opening of the axial wall of the second housing section. Thus, there is a fluidically optimized edge-free transition between the housing and the fan.

Other advantageous further developments of the disclosure are shown in the subclaims or are illustrated in more detail below together with the description of the preferred embodiment of the disclosure with reference to the figures. In the figures:

DRAWINGS

DETAILED DESCRIPTION

Figure 1:
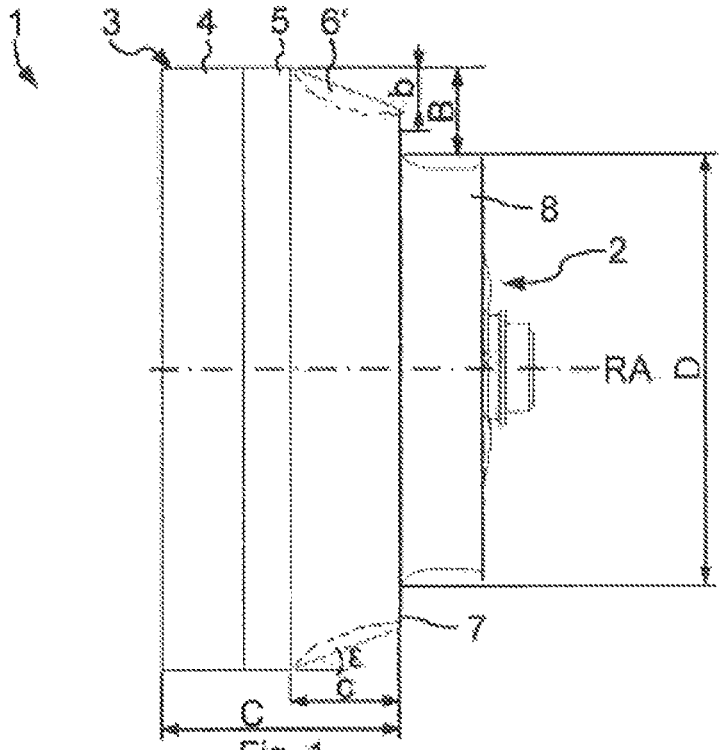
FIG. 1 is a side schematic view of an exemplary embodiment of a ventilation unit.
Figure 2:
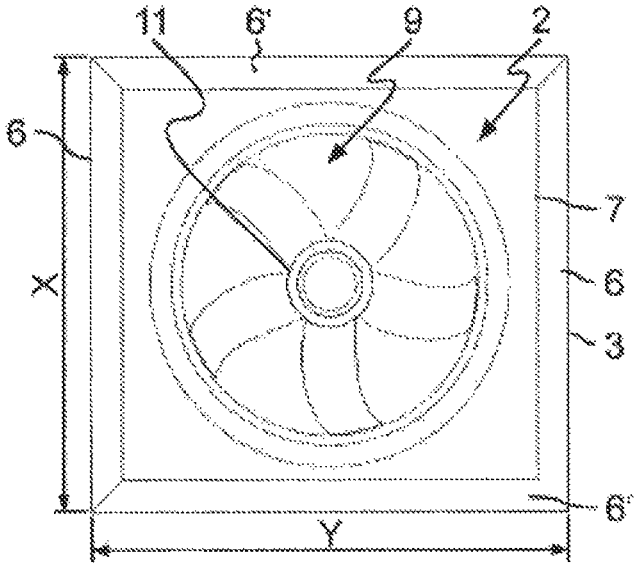
FIG. 2 is a front schematic view of the exemplary embodiment of the ventilation unit according to FIG. 1.
Figure 3:
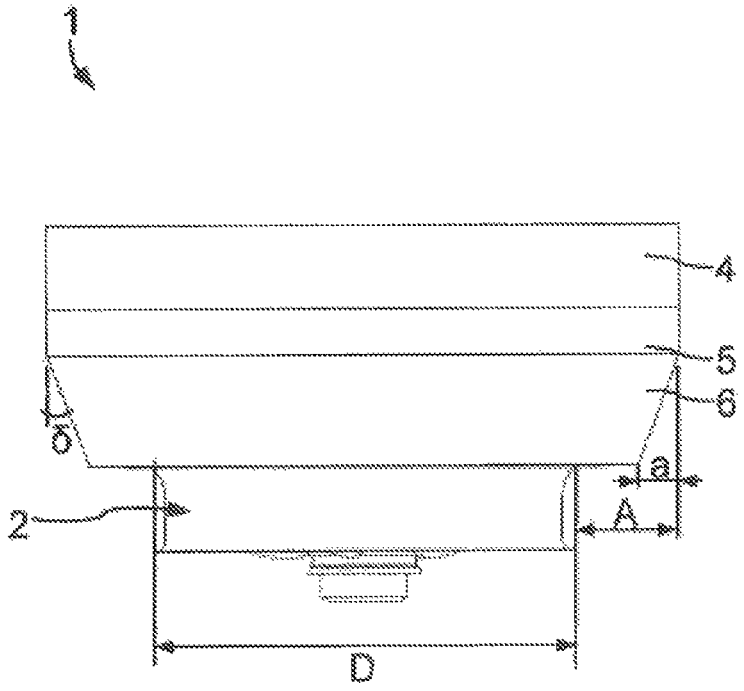
FIG. 3 is a top schematic view of the exemplary embodiment of the ventilation unit according to FIG. 1.

In FIGS. 1-3, an exemplary embodiment of a ventilation unit 1 is shown in a side view, front view, and top view. The ventilation unit 1 includes a housing 3 formed by a first housing section 4 and a second housing section 5 directly adjoining the first housing section 4 in the axial flow direction. The fan 2 is attached to the second housing section 5. The heat exchanger (not shown) is arranged in the first housing section 4. Alternatively, a housing section of the heat exchanger can also form the first housing section 4 of the housing 3. The first housing section 4 and the directly adjoining front part of the second housing section 5 have the same rectangular cross-sectional shape with the two side lengths X, Y and thus form a constant flow cross-section. In the second housing section 5, the housing wall sections 6, 6' run inclined along a plane towards the axis of rotation of the fan 2. Thus, this reduces the flow cross-section of the second housing section 5 in the flow direction towards the fan 2. However, as an alternative embodiment, which is not shown the housing wall sections 6, 6' do not extend rectilinearly along a plane but, at least in sections, in an arcuate shape towards the fan 2. The second housing section 5 provides an intake chamber for the fan 2 through which a flow can pass in an unobstructed manner and where the intake air is guided via the housing wall sections 6, 6' in the direction of the fan 2.

The axial end of the housing 3, facing the fan 2, is closed with the axial wall 7 where the axial opening 9 is provided axially centrally, where the fan 2 is arranged. In operation, the fan 2 sucks air through the housing 3 and thus through the heat exchanger and blows it out axially. The fan 2 includes a fan wheel 11 arranged in the fan housing 8. The fan housing 8 is formed in the shape of a nozzle and determines the intake diameter D on the intake side that is identical to the diameter of the axial opening 9 of the axial wall 7, but is smaller than the side lengths X and Y. According to the embodiment shown in FIG. 2, the ratio X/D=1.2 and the ratio Y/D=1.3. As an alternative to an axial fan, a diagonal fan is used in a further embodiment.

Figure 4:
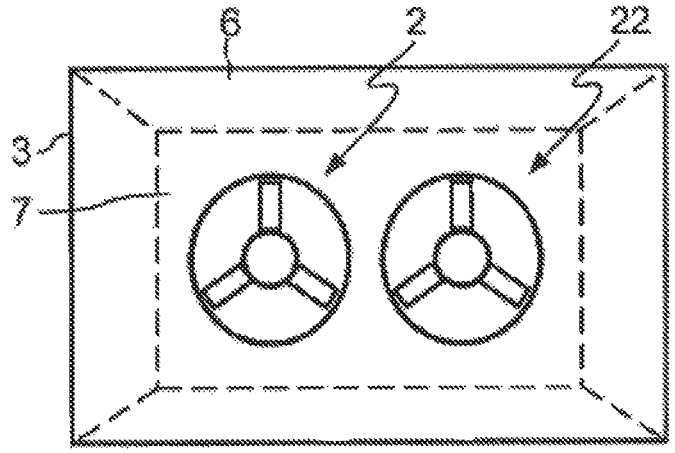
FIG. 4 is a schematic view of an alternative exemplary embodiment of a ventilation unit.

In FIG. 4, an alternative exemplary embodiment of the ventilation unit 1 is shown in top view comparable to FIG. 2. All the features disclosed for the exemplary embodiment according to FIGS. 1-3 also apply accordingly to FIG. 4, except that two fans 2, 22 are arranged parallel to each other.

Figure 5:
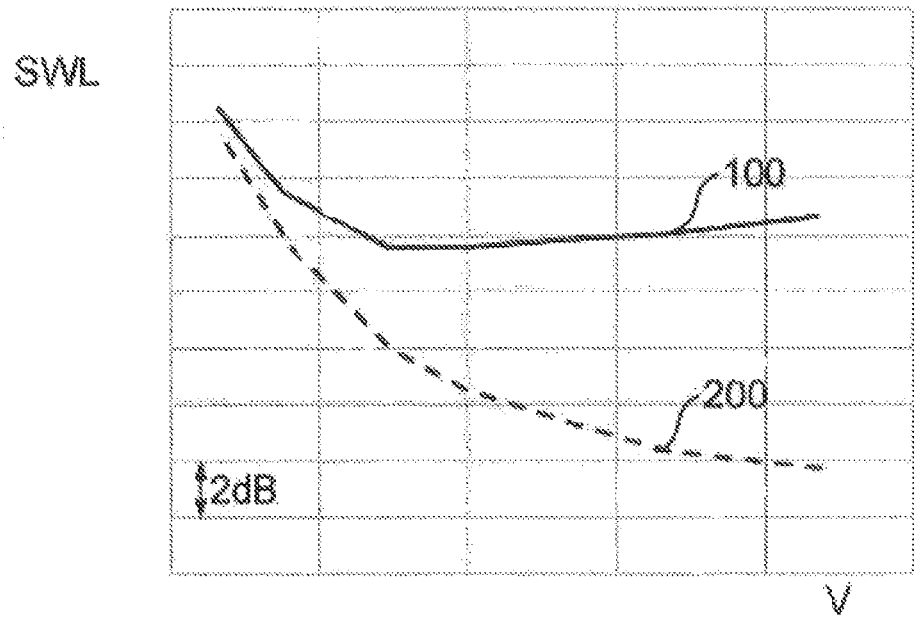
FIG. 5 is a diagrammatic view of the sound power plotted over the volume flow of the ventilation unit according to FIG. 1.
Figure 6:
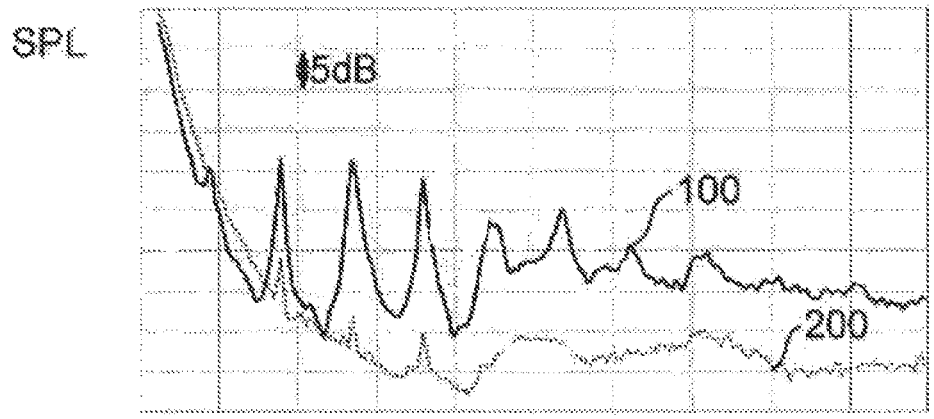
FIG. 6 is a diagrammatic view of the sound level plotted over the frequency of the ventilation unit according to FIG. 1.

In FIG. 5, the advantage with regard to the sound power SWL [dB] plotted over the conveyed volume flow V [$m^3/h$] of the ventilation unit 1, shown in FIGS. 1-3, is illustrated in a diagram. The sound power of the ventilation unit 1 is illustrated by the curve 200, a comparison product without the configuration of the second housing section 5 according to the disclosure is illustrated by the curve 100. Correspondingly, FIG. 6 shows the two curves of the ventilation unit 1 (curve 200) and the comparison product (curve 100) with respect to the sound pressure SPL [dB] plotted over the frequency f [Hz]. In both diagrams according to FIGS. 5 and 6, the noise reduction is clearly detectable over the entire progression of the volume flow V and the frequency f. In particular, at high volume flow rates, the sound power level is reduced considerably.

Referring again to FIGS. 1-3, in addition to the embodiment shown, modifications in the size ratios are comprised by the scope of the disclosure. The side lengths are determined in a range $0.5<X/Y<2$. The dimensioning of the housing wall sections 6, 6' and the extent drawn in towards the fan 2 with respect to the available installation space of the housing 3 is determined by the sizes a, b, c in relation to the sizes A, B and C. Preferably, the sizes a, b and c are smaller than the installation space sizes of the housing determined by A, B and C by a factor $\alpha$, $\beta$ and $\gamma$, such that $a=\alpha A$, $b=\beta B$ and $c=\gamma C$, where $0<\alpha,\beta,\gamma\leq 1$.

Preferably, the factors $\alpha$, $\beta$ and $\gamma$ and thus the geometry of the housing wall sections 6, 6' are designed with respect to the intake diameter D of the fan 2 such that $$0.2 \cdot D \leq C \leq 0.5 \cdot D$$

$$\alpha \geq 0.4 \text{ and } y \geq 0.3 \text{ for } 0.1 \cdot D \leq A \leq 0.3 \cdot D$$

$$\beta \geq 0.4 \text{ and } y \geq 0.3 \text{ for } 0.1 \cdot D \leq B \leq 0.3 \cdot D$$

$$\alpha \geq 0.2 \text{ and } y \geq 0.25 \text{ for } 0.3 \cdot D \leq A \leq 0.5 \cdot D$$

$$\beta \geq 0.2 \text{ and } y \geq 0.25 \text{ for } 0.3 \cdot D \leq B \leq 0.5 \cdot D$$

In a further variant, the length extent c is determined with respect to the lengths a, b such that $$\delta \geq I \cdot y + J \quad \text{for } 0 \leq y \leq 0.5$$
$$\delta \geq K \quad \text{for } 0.5 < y \leq 1$$
$$\varepsilon \geq I \cdot y + J \quad \text{for } 0 \leq y \leq 0.5$$
$$\delta \geq K \quad \text{for } 0.5 < y \leq 1$$

Wherein $$\epsilon = a\tan\left(\frac{b}{c}\right) \text{ and } \delta = a\tan\left(\frac{a}{c}\right)$$

The values for I, J and K are:
I=−200; J=120 and K=20. In addition, 0<δ, ε≤90°. With the size ratios given in these ranges, the advantageous flow effects for solving the object described above can be achieved. The specified size ratios expressly apply not only to the exemplary embodiment shown in FIGS. 1-3, but generally also to the second housing section 5.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A ventilation unit comprising:

at least one fan, a heat exchanger, arranged axially spaced from the fan, and a housing, the housing has a first housing section and a second housing section, the first housing section has a constant flow cross-section where the heat exchanger is arranged, the second housing section adjoins the first housing section in an axial flow direction;

the fan is arranged at the second housing section and, in operation, the fan conveys air through the heat exchanger, arranged in the first housing section, and through the second housing section;

a flow cross-section of the second housing section is reduced in the axial flow direction from the first housing section to the fan by an adaptation of a shape of housing wall sections of the second housing section;

flow inserts are arranged in the second housing section, the flow inserts are formed in sections running obliquely towards an axis of rotation of the at least one fan and reduce the flow cross-section of the second housing section in a direction of the at least one fan.

2. The ventilation unit according to claim 1, wherein the second housing section defines an intake chamber for the at least one fan and a flow can freely pass through the intake chamber.

3. The ventilation unit according to claim 1, wherein the second housing section includes an outflow-side axial wall with an axial opening formed in the outflow-side axial wall and the at least one fan is arranged, placed, onto the outflow-side axial wall at the axial opening.

4. The ventilation unit according to claim 3, wherein at least the first housing section is formed rectangularly with two different side lengths and an intake diameter of the at least one fan facing the heat exchanger is smaller than each side length of the first rectangular housing section.

5. The ventilation unit according to claim 4 wherein a ratio of an axial length of the second housing section with respect to the intake diameter of the at least one fan is specified in a range such that 0.2≤ C/D≤0.5.

6. The ventilation unit according to claim 4 wherein the housing is formed rectangularly with two different side lengths, and a ratio of each side length to the intake diameter of the at least one fan is specified in a range such that $$1.1 \leq (X)/D \leq 2.0 \text{ and } 1.1 \leq (Y/D \leq 2.0.$$

7. The ventilation unit according to claim 4 wherein the at least one fan has a fan housing that determines the intake diameter.

8. The ventilation unit according to claim 7 wherein the intake diameter of the fan housing has a size identical to the axial opening of the outflow-side axial wall of the second housing section.

9. The ventilation unit according to claim 3 wherein two or more fans of the at least one fan are arranged axially parallel to one another on the outflow-side axial wall of the second housing section.

10. The ventilation unit according to claim 1 wherein the housing wall sections of the second housing section are formed in sections running obliquely towards an axis of rotation of the at least one fan.

11. The ventilation unit according to claim 1, wherein the flow inserts are perforated guide plates and a cavity, formed between the housing and the guide plates, is filled with sound-absorbing material.

12. The ventilation unit according claim 1 wherein the housing wall sections of the second housing section each extend along a plane.

13. The ventilation unit according to claim 1 wherein the housing wall sections of the second housing section each have a curved profile shape.

* * * * *